United States Patent [19]

Beetle

[11] Patent Number: 4,667,726

[45] Date of Patent: May 26, 1987

[54] METHOD OF AND APPARATUS FOR IMMERSION CASTING

[76] Inventor: Robert H. Beetle, 344 Morris Ave., Mountain Lakes, N.J. 07046

[21] Appl. No.: 720,716

[22] Filed: Apr. 8, 1985

[51] Int. Cl.[4] ..... B22D 23/04

[52] U.S. Cl. ..... 164/72; 164/136; 164/271

[58] Field of Search ..... 164/47, 4.1, 131, 133, 164/136, 137, 271, 410, 72

[56] References Cited

U.S. PATENT DOCUMENTS

| | | | |
|---|---|---|---|
| 3,367,189 | 2/1968 | Curry, Jr. | 164/4.1 X |
| 3,786,857. | 1/1974 | Sutherland | 164/136 X |
| 3,995,826 | 12/1976 | Saunders | 164/136 X |
| 4,411,305 | 10/1983 | Beetle | 164/271 X |

FOREIGN PATENT DOCUMENTS

| | | | |
|---|---|---|---|
| 553551 | 6/1932 | Fed. Rep. of Germany | 164/136 |
| 846089 | 7/1981 | U.S.S.R. | 164/271 |
| 988452 | 1/1983 | U.S.S.R. | 164/410 |

*Primary Examiner*—Nicholas P. Godici
*Assistant Examiner*—J. Reed Batten, Jr.
*Attorney, Agent, or Firm*—Eric P. Schellin

[57] ABSTRACT

Metal castings are prepared using thin rigid closed molds by submerging the mold in a bath of high temperature molten metal, with removal of the mold from the bath being handled to hold the metal inside the mold, but to allow the excess metal to run off the exterior of the mold without metal freezing there which could cause damage or locking-in of the mold.

8 Claims, 5 Drawing Figures

METHOD OF AND APPARATUS FOR IMMERSION CASTING

BACKGROUND OF THE INVENTION

FIELD OF THE INVENTION

This invention relates to a foundry process and apparatus using thin rigid closed molds by submerging most or all of the mold below the surface of a molten metal bath, with removal of the mold being handled to hold the metal inside the mold.

High melting point metals and their alloys are traditionally melted in furnaces and then transferred to ladles for gravity pouring into molds of sand, metal, graphite, refractory or ceramic materials. It is sometimes advisable to have molten metal (or alloys) enter the molds directly from the furnace, ladles, or a pouring arrangement, by using vacuum, air or gas pressure, or metal pumps using electromagnetic or other forces to offset gravity (or sometimes to supplement gravity.) Centrifugal force is also used to pressure molten metal into mold cavities as a part of the pouring process.

With some of the aforesaid pouring arrangements, the molten metal or alloy may at some point cover part of a mold's exterior face as with the pouring basin or gate connection. When forming a vacuum seal so that molten metal can be pulled into the mold gates, it is sometimes desirable to immerse the bottom exterior face of the mold in the melt to gain a seal, and even some minor portions of the side exterior faces of the mold can be immersed also for such vacuum seals.

In accordance with the present invention a foundry method comprises assembling and closing an openable rigid mold body represented by metal-confining separable exterior walls defining a mold cavity and substantially uniformly composed of a glass-ceramic converted from the glassy state by devitrification to a polycrystalline ceramic existing substantially as a single phase microstructure, said metal-confining exterior walls having at least one in-gate to admit molten metal into said mold cavity, submerging substantially completely said entire mold body below the surface of a bath of molten metal at a temperature of at least about 2000° F., admitting molten metal from said bath into said mold cavity through said in-gate, disposing said submerged mold in said bath with said in-gate at the highest level of the mold cavity representing the part to be cast, removing said mold body with molten metal therein from said bath while said mold is so disposed, solidifying the metal content of said mold to form a solidified cast metal part, and recovering said solidified cast metal part from said mold.

Also in accordance with the present invention is an apparatus which comprises an openable rigid mold body of metal-confining separable exterior walls defining a mold cavity and substantially uniformly composed of a glass ceramic converted from the glassy state by devitrification to a polycrystalline ceramic existing substantially as a single phase microstructure, said metal-confining exterior walls having at least one in-gate to admit molten metal into said mold cavity, means for closing said openable rigid mold body, means for submerging substantially completely said mold body in a bath of molten meal, means for disposing said mold while in said bath with said in-gate at the highest level of the mold cavity representing the part to be molded, means for removing said mold body from said bath with said in-gate so disposed, means for cooling said removed mold to solidify metal which has entered therein from said bath through said in-gate, and means for removing such solidified metal from said mold.

The process and apparatus of the present invention take advantage of the metallostatic pressure head and the melt's high temperature and radiant heat to preheat the mold, vent its gasses, and to run and feed the casting's sections when the mold is submerged.

The mold itself provides important contributions to the invention. Suitable mold materials which maximize heat transfer in thin wall (up to about one centimeter but preferably on the order of about five millimeters in thickness) mold sections are disclosed in my U.S. Pat. No. 4,411,305. These mold materials provide smooth exterior walls which avoid the problems of metal remaining on the mold exterior after the mold is removed from the melt. Such thin wall molds reduce the mold size required for a given casting and the molten metal displacement necessary for submerged casting. The reduced mold size also simplifies equipment needs since submerged casting requires that all of the mold be below the top surface of the molten metal bath, except for such provision to vent the mold atmosphere and any core gases as may be appropriate. (In this regard it is to be noted that another advantage of the mold sections of my U.S. Pat. No. 4,411,305, is that they are free of any generation of gases per se.

When required, venting can be accomplished by a "chimney" projecting from the mold above the top surface of the bath for as long as it is necessary for venting. The submersion of the mold along with the position and motion given to it uses the heat of the bath and its metallostatic pressure head to preheat the mold and force out the mold atmosphere (and any core or other gases developed) while pressuring the flow of metal into the mold to run even thin, difficult sections. Alternatively, the mold atmosphere may be forced under the metallostatic pressure head into a small cavity or chamber provided at the top of the mold cavity to act as a receiver therefor.

Although the submerged casting process can be carried out by submersion of a mold in a furnace, ladle, trough, or a pouring arrangement containing molten metal, it can also be accomplished by placing the mold in a vessel that is subsequently filled with a molten metal that rises above the mold. The rise of the metal bath around and over the mold can thus be accomplished by lowering the mold or by raising the bath level, or both simultaneously. Both methods utilize the same principle of combined pressure head from the metallostatic source, heat, melt fluidity and its uniformity for venting, gating, running and feeding the submerged mold.

Positioning of the mold vents and mold in-gate(s) will depend on the casting shape and its requirements. Generally vents are most useful when open to the atmosphere during the "gas off." Normally the vent exit is positioned above the in-gate during the initial mold entry into and motion in the melt or bath. "Chimney" type vent extensions can allow the in-gate to be higher than the vent connection to the casting. Once the mold is filled, its removal from the molten bath requires that the in-gate(s) and any feeding reservoirs are above the casting sufficiently to prevent undesired runnout. It is desirable to have the mold leave the melt in a manner that minimizes the length of ingate for removal in subsequent cleaning operations, and in a method that drains any exterior mold pockets that would result in an unwanted "skull" as the metal solidifies.

BRIEF DESCRIPTION OF THE DRAWINGS

The invention is illustrated in the accompanying drawings, in which.

DETAILED DESCRIPTION OF THE INVENTION

Figure 3:
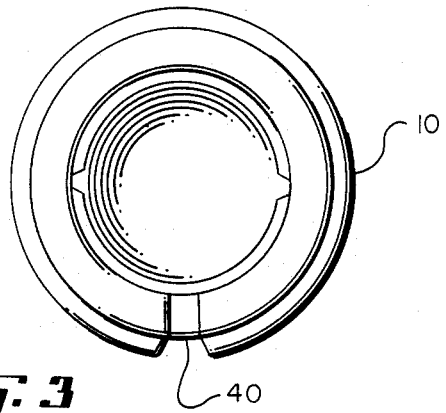
FIG. 3 is a top plan view of the drag or bottom portion of the mold of FIG. 1.
Figure 4:
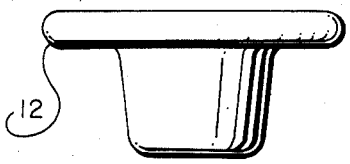
FIG. 4 is a side view in elevation of the cope or top portion of the mold of FIG. 1.
Figure 1:
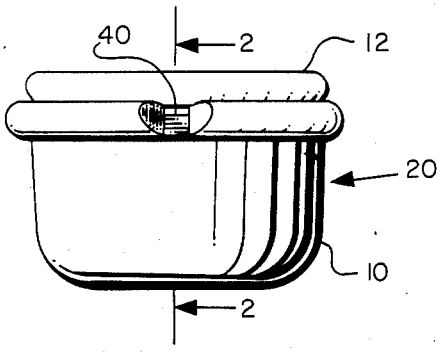
FIG. 1 is a side view in elevation of a closed two-piece mold in accordance with the present invention.
Figure 2:
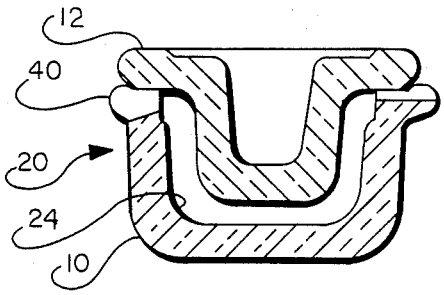
FIG. 2 is a view in cross-section of the mold of FIG. 1 taken along the line 2—2 thereof.

Referring now more specifically to the accompanying drawings, a drag 10 and a cope 12 are assembled and closed to form a mold indicated generally by reference numeral 20. The mold cavity 24 defined by the drag and cope is that of a conventional pipe cap 30.

The mold walls are essentially uniform in crosssectional thickness, being approximately five millimeters thick. The mold is made of CORNING 9608 glass-ceramic in which the crystalline phase is spodumene, and all surfaces of the mold are coated with a thin zircon base mold wash.

The top horizontal surface of the drag is notched in diametrically opposed locations to form an in-gate 40 and a vent 44. The in-gate is characterized by a minimum opening cross-sectional area of about sixteen square millimeters, and the vent by a maximum cross-sectional area of about one square millimeter. Thus, the in-gate freely admits molten metal into the mold cavity, but the vent, while large enough readily to permit the mold atmosphere to be expelled therethrough, is too small to pass molten metal.

Figure 5:
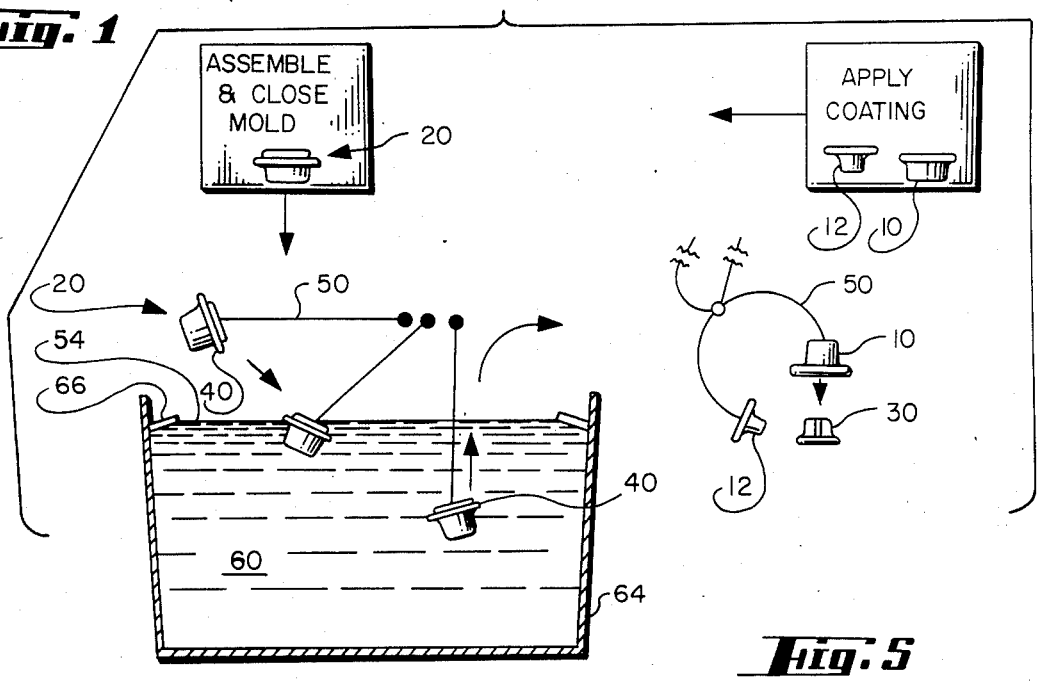
FIG. 5 is a schematic diagram of an apparatus for use in carrying out the process of the present invention.

As best illustrated in FIG. 5, the coated mold parts are assembled and closed by a holding fixture 50. The holding fixture is positioned with the mold held above the top surface 54 of a bath 60 of molten iron having a carbon content of 3.5%, a silicon content of 2.2%, and a temperature of 2560° F. The holding fixture 50 is pivoted such that as the mold 20 approaches and enters the top 54 of the bath 60, the vent 44 is the last element of the mold to be submerged.

The molten iron bath is retained in a furnace 64. The molten iron forms a meniscus in the furnace, which meniscus causes the surface of the molten iron bath to deflect downwardly around its periphery at the wall of the furnace at the region of contact therewith. As any slag 66 flows across the surface of the molten iron 60 and accumulates at the meniscus, the holding fixture 50 is positioned to enter the mold into the bath in the central, slag-free portion thereof.

It should also be noted that the progressive entry of the mold into the bath from above, with the vent 44 being the last part of the mold to enter the bath, permits the mold to be prheeated by radiant heat from the bath as the mold approaches the upper surface thereof. This is an aid in reducing thermal shock to the mold, and also facilitates expulsion of the thus heated mold atmosphere from the mold as liquid iron enters through the in-gate 40 and fills the mold cavity 24.

As the mold material is impervious and generates no decomposition gases or the like, once the mold atmosphere has been expelled through the vent the mold cavity is filled in an essentially gas-free environment and the concomitant benefits thereof are enjoyed without recourse to vacuum casting or the like. Additional benefits enjoyed in the instant process include uniform casting temperatures for all molds (as long as the bath temperature is kept constant) and a highly polished, smooth final finish on the cast pieces thus produced (as a result of the absence of gas and the smooth impervious finish of the mold surfaces.)

The mold is advanced progressively deeper into the bath and is repositioned while fully submerged to dispose the in-gate at the highest level of the mold cavity in order to preclude undesirable loss of metal from the mold through the in-gate as the mold is lifted vertically out of the bath (while the metal is still liquid.) It is feasible to fill a mold quite quickly, i.e., in times as short as five seconds or less, and preferably as short as three seconds.

Once removed from the bath, the mold and its contents cool very quickly by infra-red radiation, convection, etc., and the mold is inverted, the cast metal part is removed therefrom under the force of gravity, and the mold parts are recoated with mold wash as desired, assembled and closed again, and re-used.

It should be noted that in addition to conventional mold washes, it may be desirable to coat certain or all outer surfaces of the mold with an insulating material such as KAOWOOL made by Babcock & Wilcox Company.

What is claimed is:

1. A foundry method which comprises: (1) assembling and closing an openable rigid mold body represented by metal-confining separable exterior thin walls up to one centimeter in thickness defining a closed mold cavity and substantially uniformly composed of a glass-ceramic converted from the glassy state by devitrification to a polycrystalline ceramic existing substantially as a single phase microstructure, said metal-confining walls having at least one in-gate to admit molten metal into said mold cavity; and a vent large enough to permit mold body atmosphere to be expelled but too small to pass molten metal, (2) submerging substantially completely said entire mold body below the surface of a bath of molten metal at a temperature of at least about 2000° F., (3) admitting molten metal from said bath into said mold cavity through said in-gate, (4) disposing said submerged mold body in said bath with said in-gate at the highest level of the mold cavity representing the part to be cast, (5) removing said mold body with molten metal therein from said bath while said mold body is so disposed, (6) solidifying the metal content of said mold body to form a solidified cast metal part, and (7) recovering said solidified cast metal part from said mold body.

2. A foundry method as set forth in claim 1 in which said mold body is reassembled and re-used.

3. A foundry method as set forth in claim 2 in which said vent is the last part of said mold body to enter said bath.

4. A foundry method for the production of cast metal parts which comprises assembling and closing an openable rigid mold body represented by metal-confining separable exterior thin walls up to one centimeter in thickness defining a mold cavity, said metal-confining walls having at least one in-gate to admit molten metal into said mold cavity and a vent large enough to permit mold body atmosphere to be expelled but too small to pass molten metal, submerging said mold body below the surface of a bath of molten metal having a temperature of at least about 2000° F., admitting molten metal from said bath into said mold cavity through said in-gate, removing said mold body from said bath with said admitted molten metal retained in said cavity, solidifying said admitted metal in said cavity, opening said openable mold body, and recovering said solidified metal as a cast metal part.

5. A foundry method as set forth in claim 4 in which said mold body is reassembled and re-used.

6. A foundry method as set forth in claim 4 in which said metal-confining walls are about five millimeters thick and are substantially uniformly composed of a glass-ceramic in which the predominant microstructure is polycrystalline ceramic converted from the glassy state by devitrification, said polycrystalline ceramic existing as a single phase microstructure, said walls also being coated with a mold wash.

7. A re-usable foundry apparatus for the production of cast metal parts which comprises a re-usable openable rigid mold body of metal-confining separable exterior thin walls up to one centimeter in thickness defining a closed mold cavity and substantially uniformly composed of a glass ceramic, said metal-confining exterior walls having at least one in-gate to admit molten metal into said closed mold cavity and a vent large enough to permit mold body atmosphere to be expelled but too small to pass molten metal, means for closing said openable rigid mold body, means for submerging substantially completely said mold body in a bath of molten metal, means for disposing said mold body while in said bath with said in-gate positioned to admit molten metal from said bath to said mold cavity, means for removing said mold body from said bath after said mold cavity is charged with molten metal, and means for opening said mold body after cooling and solidification of the molten metal.

8. A foundry apparatus as set forth in claim 7 in which said means for submerging said mold body is so disposed that said vent is the last element of said mold body to be submerged in said bath of molten metal.

* * * * *